US010581137B2

(12) United States Patent
Hussain et al.

(10) Patent No.: US 10,581,137 B2
(45) Date of Patent: Mar. 3, 2020

(54) STRETCHABLE ANTENNA FOR WEARABLE ELECTRONICS

(71) Applicant: KING ABDULLAH UNIVERSITY OF SCIENCE AND TECHNOLOGY, Thuwal (SA)

(72) Inventors: Muhammad Mustafa Hussain, Austin, TX (US); Aftab Mustansir Hussain, Thuwal (SA); Atif Shamim, Thuwal (SA); Farhan Abdul Ghaffar, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 207 days.

(21) Appl. No.: 15/761,533

(22) PCT Filed: Oct. 5, 2016

(86) PCT No.: PCT/IB2016/055965

§ 371 (c)(1),
(2) Date: Mar. 20, 2018

(87) PCT Pub. No.: WO2017/060835

PCT Pub. Date: Apr. 13, 2017

(65) Prior Publication Data

US 2019/0058236 A1 Feb. 21, 2019

Related U.S. Application Data

(60) Provisional application No. 62/238,971, filed on Oct. 8, 2015.

(51) Int. Cl.
*H01Q 1/08* (2006.01)
*H01Q 1/27* (2006.01)
(Continued)

(52) U.S. Cl.
CPC ..... *H01Q 1/085* (2013.01); *H01Q 1/273* (2013.01); *H01Q 1/38* (2013.01); *H01Q 9/42* (2013.01)

(58) Field of Classification Search
CPC ..... H01Q 1/085; H01Q 9/42; H01Q 1/273; H01Q 1/38
See application file for complete search history.

(56) References Cited

U.S. PATENT DOCUMENTS 7,586,463 B1 9/2009 Katz
8,736,452 B1 5/2014 Varahramyan et al.
(Continued)

FOREIGN PATENT DOCUMENTS

WO 2014138204 A1 9/2014

OTHER PUBLICATIONS

Arriola, A. et al., "Stretchable Dipole Antenna for Body Area Networks at 2.45 GHz," IET Microwaves, Antennas &Propagation, Jun. 9, 2011, vol. 5, Issue 7, pp. 852-859.
(Continued)

*Primary Examiner* — Hai V Tran
*Assistant Examiner* — Michael M Bouizza
(74) *Attorney, Agent, or Firm* — Patent Portfolio Builders PLLC

(57) ABSTRACT

Various examples are provided for stretchable antennas that can be used for applications such as wearable electronics. In one example, a stretchable antenna includes a flexible support structure including a lateral spring section having a proximal end and at a distal end; a metallic antenna disposed on at least a portion of the lateral spring section, the metallic antenna extending along the lateral spring section from the proximal end; and a metallic feed coupled to the metallic antenna at the proximal end of the lateral spring section. In another example, a method includes patterning a polymer
(Continued)

layer disposed on a substrate to define a lateral spring section; disposing a metal layer on at least a portion of the lateral spring section, the metal layer forming an antenna extending along the portion of the lateral spring section; and releasing the polymer layer and the metal layer from the substrate.

20 Claims, 12 Drawing Sheets

(51) Int. Cl.
*H01Q 1/38* (2006.01)
*H01Q 9/42* (2006.01)

(56) References Cited

U.S. PATENT DOCUMENTS

2015/0054696 A1 2/2015 Werner et al.
2015/0189753 A1* 7/2015 Goyal ..... G06F 1/163 361/803
2015/0373831 A1* 12/2015 Rogers ..... H01L 23/22 429/121
2017/0018843 A1* 1/2017 Kourti ..... H01Q 1/273

OTHER PUBLICATIONS

Chang, Y., et al., "Copper Nanowire Based Transparent Conductive Films with High Stability and Superior Stretchability," Journal of Materials Chemistry C, Apr. 10, 2014, vol. 2, pp. 5309-5316.
Cheng, S., et al., "Foldable and Stretchable Liquid Metal Planar Inverted Cone Antenna," IEEE Transactions on Antennas and Propagation, Dec. 2009, vol. 57, No. 12, pp. 3765-3771.
Cui, M., et al., "Roles of Chromatin Factors in C. elegans Development," WormBook, ed. Tehe C. elegans Research Community, WormBook, May 3, 2007, http://www.wormbook.org.
Fan, J.A., et al., "Fractal Design Concepts for Stretchable Electronics," Nature Communications, Feb. 7, 2014, vol. 5, pp. 1-8.
Fang, D.G., "Antenna Theory and Microstrip Antennas," Science Press, 2009.
Hsu, Y.-Y., et al., "Design for Reliability of Multi-Layer Stretchable Interconnects," Journal of Micromechanics and Microengineering, Aug. 11, 2014, vol. 24, pp. 1-7.
Hsu, Y.-Y., et al., Polyimide-Enhanced Stretchable Interconnects: Design, Fabrication, and Characterization, IEEE Transactions on Electron Devices, Aug. 2011, vol. 58, No. 8, pp. 2680-2688.
Hussain, A.M., et al., "Ultrastretchable and Flexible Copper Interconnect-Based Smart Patch for Adaptive Thermotherapy," Advanced Healthcare Materials, Apr. 7, 2015, vol. 4, pp. 665-673.
Kaltenbrunner, M, et al., "An Ultra-Lightweight Design for Imperceptible Plastic Electronics," Nature, Letter, Jul. 25, 2013, vol. 499, pp. 458-466.
Kim, D.-H., et al., "Epidermal Electronics," Science, Aug. 12, 2011, vol. 333, pp. 838-843.
Kim, D.-H., et al., "Materials for Multifunctional Balloon Catheters with Capabilities in Cardiac Electrophysiological Mapping and Ablation Therapy," Nature Materials, Apr. 2011, vol. 10, pp. 316-323.
Kim, J., et al., "Epidermal Electronics with Advanced Capabilities in Near-Field Communications," Small, Feb. 19, 2015, vol. 11, No. 8, pp. 906-912.
Kubo, M., et al., "Stretchable Microfluidic Radiofrequency Antennas," Advance Materials, Apr. 22, 2010, vol. 11, pp. 2749-2752.
Lacour, S.P., et al., "Stretchable Interconnects for Elastic Electronic Surfaces," Proceedings of the IEEE, Aug. 2005, vol. 93, No. 8, pp. 1459-1467.
Lv, C. et al., "Archimedean Spiral Design for Extremely Stretchable Interconnects," Extreme Mechanics Letters I, Dec. 17, 2014, pp. 29-34.
Lee, M.-S. et al., "Studies on the Mechanical Stretchability of Transparent Conductive Film Based on Graphene-Metal Nanowire Structures," Nanoscale Research Letters, Jan. 31, 2015, pp. 1-9.
Makin, M.J., et al., "Irradiation Hardening in Copper and Nickel," ACTA Metallurgica, Oct. 1960, vol. 8, pp. 691-699.
Norton, J.J.S., et al., "Soft, Curved Electrode Systems Capable of Integration on the Auricle as a Persistent Brain-Computer Interface," PNAS, Mar. 31, 2015, vol. 112, No. 13, pp. 3920-3925.
Rojas, J.P., et al., "Design and Characterization of Ultra-Stretchable Monolithic Silicon Fabric," Applied Physics Letters, 2014, vol. 105, pp. 154101-1-154101-5.
Rojas, J.P., et al., "Transformational Silicon Electronics," ACS Nano, Jan. 29, 2014, vol. 8, No. 2, pp. 1468-1474.
So, J.-H., et al., "Reversibly Deformable and Mechanically Tunable Fluidic Antennas," Advanced Functional Materials, Sep. 30, 2009, vol. 19, pp. 3632-3637.
Someya, T., et al., "A Large-Area, Flexible Pressure Sensor Matrix with Organic Field-Effect Transistors for Artificial Skin Applications," PNAS, Jul. 6, 2004, vol. 101, No. 27, pp. 9966-9970.
Someya, T., et al., "Conformable, Flexible, Large-Area Networks of Pressure and Thermal Sensors with Organic Transistor Active Matrixes," PNAS, Aug. 30, 2005, vol. 102, No. 35, pp. 12321-12325.
Someya, T., et al., "Large-Area Detectors and Sensors," Organic Electronics, Materials, Manufacturing and Applications, Aug. 28, 2006, pp. 395-410.
Son, D., et al., "Multifunctional Wearable Devices for Diagnosis and Therapy of Movement Disorders," Nature Nanotechnology, May 2014, vol. 9, pp. 397-404.
Song, J., et al., "Superstable Transparent Conductive Cu@Cu4Ni Nanowire Elastomer Composites Against Oxidation, Bending, Stretching, and Twisting for Flexible and Stretchable Optoelectronics," Nano Letters, Oct. 10, 2014, vol. 14, pp. 6298-6305.
Song, L., et al., "Stretchable and Reversibly Deformable Radio Frequency Antennas Based on Silver Nanowires," ACS Applied Materials and Interfaces, Mar. 4, 2014, vol. 6, pp. 4248-4253.
Song, Y.M., et al., "Digital Cameras with Designs Inspired by the Arthropod Eye," Nature, Letter, May 2, 2013, vol. 497, No. pp. 95-99.
Torres Sevilla, G.A., et al., "Flexible and Transparent Silicon-on-Polymer Based Sub-20 nm Non-planar 3D FinFET for Brain-Architecture Inspired Computation," Advanced Materials, Feb. 22, 2014, vol. 26, pp. 2794-2799.
Torres Sevilla, G.A., et al., "Flexible Nanoscale High-Performance FinFETs," ACS Nano, Sep. 3, 2014, vol. 8, No. 10, pp. 9850-9856.
Wang, X., et al., "Stretchable Conductors with Ultrahigh Tensile Strain and Stable Metallic Conductance Enabled by Prestrained Polyelectrolyte Nanoplatforms," Advaned Materials, Mar. 20, 2011, vol. 23, pp. 3090-3094.
Won, Y., et al., "A Highly Stretchable, Helical Copper Nanowire Conductor Exhibiting a Stretchability of 700%," NPG Asia Materials, Sep. 26, 2014, vol. 6, pp. 1-7.
Woo, J.Y., et al., "Highly Conductive and Stretchable Ag Nanowire/Carbon Nanotube Hybrid Conductors," IOP Publishing, Jun. 27, 2014, vol. 25, pp. 1-8.
Xu, F., et al., "Highly Conductive and Stretchable Silver Nanowire Conductors," Advanced Materials, Jul. 12, 2012, vol. 24, pp. 5117-5122.
Xu, F., et al., "Wavy Ribbons of Carbon Nanotubes for Stretchable Conductors," Advanced Functional Materials, Jan. 19, 2012, vol. 22, pp. 1279-1283.
Xu, S., et al., "Stretchable Batteries with Self-Similar Serpentine Interconnects and Integrated Wireless Recharging Systems," Nature Communications, Feb. 26, 2013, pp. 1-8.
Xu, Y., et al., "Post-CMOS and Post-MEMS Compatible Flexible Skin Technologies: A Review," IEEE Sensors Journal, Oct. 2013, vol. 13, No. 10, pp. 3962-3975.
Yeo, W.-H., et al., "Multifunctional Epidermal Electronics Printed Directly Onto the Skin," Advanced Materials, Feb. 26, 2013, vol. 25, pp. 2773-2778.

(56) References Cited

OTHER PUBLICATIONS

Yue, G., et al., "A Highly Efficient Flexible Dye-Sensitized Solar Cell Based on Nickel Sulfide/Platinum/Titanium Counter Electrode," Nanoscale Research Letters, Jan. 10, 2015, vol. 10, No. 1, pp. 109.
Zang, Y., et al., "Advances of Flexible Pressure Sensors Toward Artificial Intelligence and Health Care Appliances," Materials Horizons, 2015, Issue 2, pp. 140-156.
Zhang, Y., et al., "A Hierarchical Computational Model for Stretchable Interconnects with Fractal-Inspired Designs," Journal of the Mechanics and Physics of Solids, Aug. 12, 2014, vol. 72, pp. 115-130.
Zu, M., et al., Carbon Nanotube Fiber Based Stretchable Conductor, Advanced Functional Materials, Sep. 18, 2013, vol. 23, pp. 789-793.
International Search Report in related International Application No. PCT/IB2016/055965, dated Nov. 25, 2016.
Written Opinion of the International Searching Authority in related International Application No. PCT/IB2016/055965, dated Nov. 25, 2016.
First Examination Report in corresponding/related GCC Application No. GC 2016-32154, dated Mar. 21, 2019 (Documents D1 and D2 were cited in the IDS filed Mar. 20, 2018).

* cited by examiner

FIG. 1A
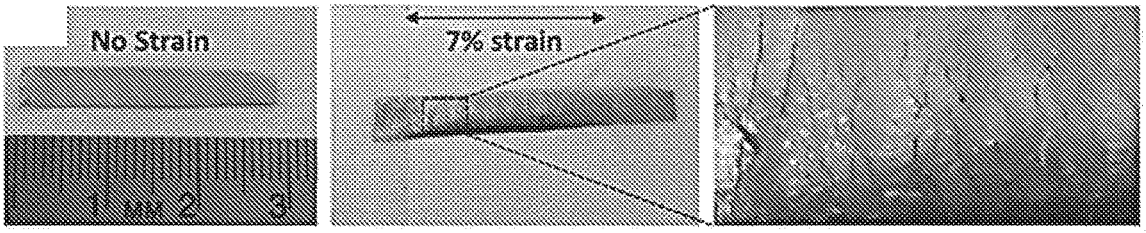
FIG. 1B
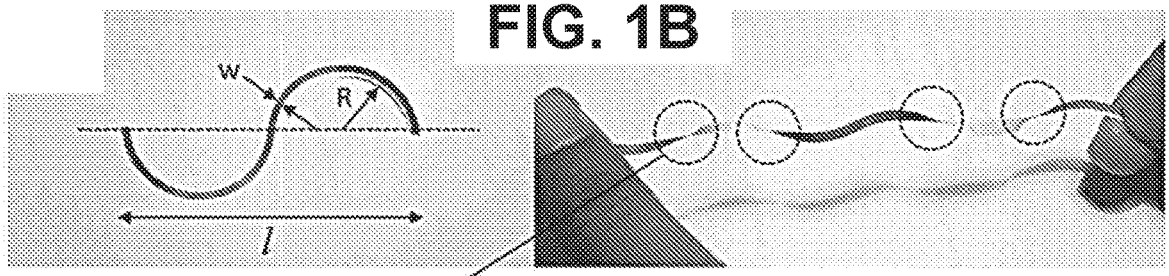
FIG. 1C
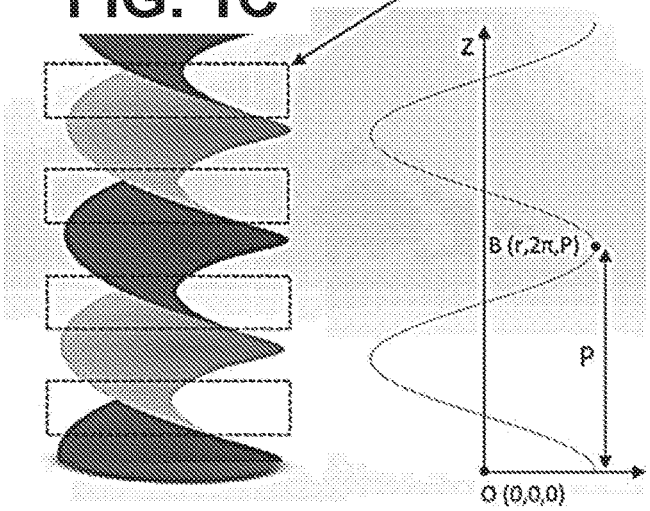
FIG. 1D
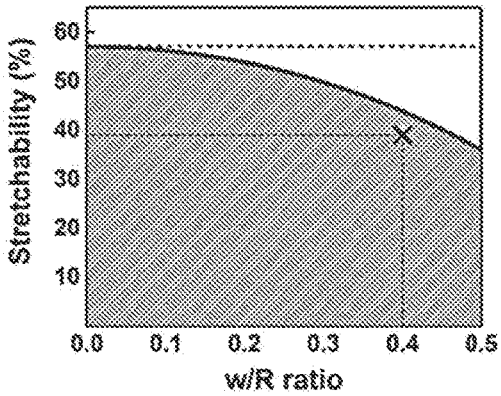
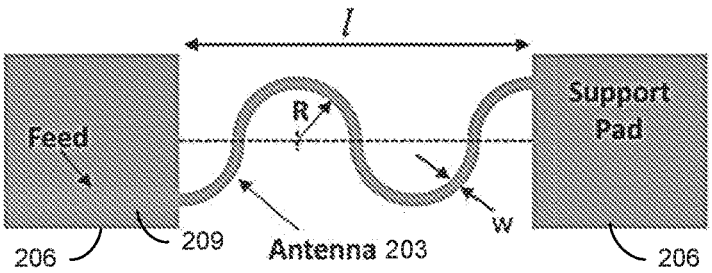
FIG. 2A
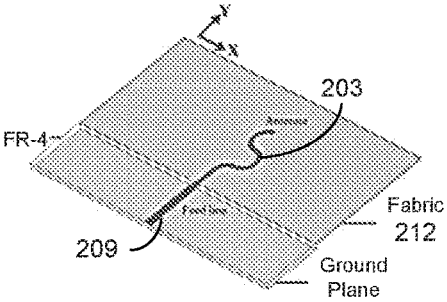
FIG. 2B FIG. 5A
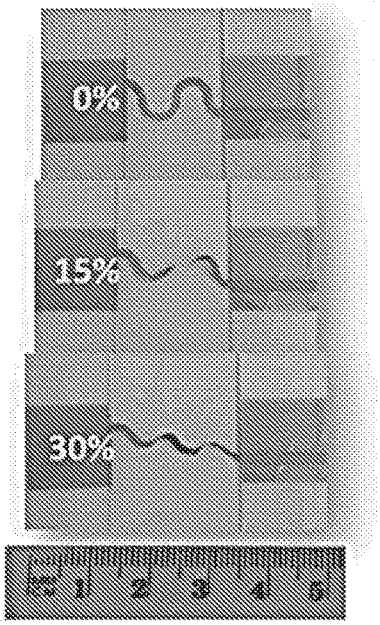
FIG. 5B
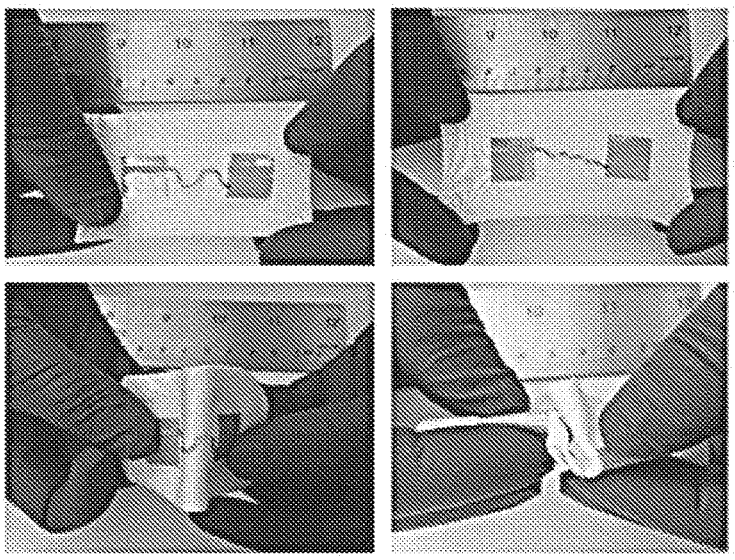
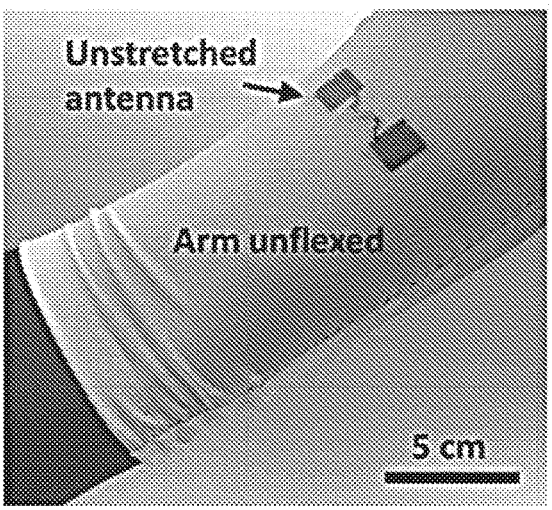
FIG. 5C
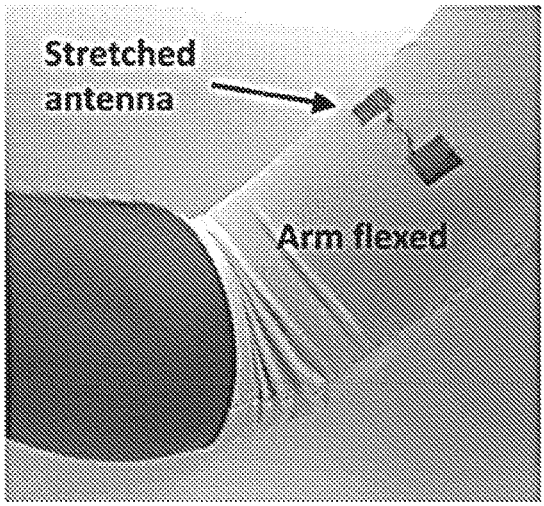
FIG. 5D

STRETCHABLE ANTENNA FOR WEARABLE ELECTRONICS

CROSS REFERENCE TO RELATED APPLICATIONS

This application is a U.S. National Stage of International Application No. PCT/IB2016/055965, filed Oct. 5, 2016, which claims priority to, and the benefit of, U.S. provisional application entitled "Metal/Polymer Based Stretchable Antenna for Constant Frequency Far-Field Communication in Wearable Electronics" having serial no. 62/238,971, filed Oct. 8, 2015, which are hereby incorporated by reference in their entirety.

BACKGROUND

Body integrated wearable electronics can be used for advanced health monitoring, security, and wellness. Due to the complex, asymmetric surface of human body and atypical motion such as stretching in elbow, finger joints, wrist, knee, ankle, etc. electronics integrated to body need to be physically flexible, conforming, and stretchable. Electronics that that are based on bulky, rigid, and brittle frameworks may be unusable in that context.

SUMMARY

Embodiments of the present disclosure are related to stretchable antennas that can be used for, e.g., wearable electronics. These include metal/polymer based stretchable antennas that can be used for constant frequency far-field communications.

In one embodiment, among others, a stretchable antenna comprises a flexible support structure comprising a lateral spring section having a proximal end and at a distal end; a metallic antenna disposed on at least a portion of the lateral spring section, the metallic antenna extending along the lateral spring section from the proximal end; and a metallic feed coupled to the metallic antenna at the proximal end of the lateral spring section. In one or more aspects of these embodiments, the lateral spring section can be a semicircular spring section.

In one or more aspects of these embodiments, the lateral spring section can be coupled at the proximal end to a first support pad and coupled at the distal end to a second support pad. The flexible support structure can comprise a polymer. The polymer can be polyimide or polydimethylsiloxane (PDMS). The metallic antenna can comprise a metallic thin film disposed on the lateral spring section. The metallic thin film can comprise copper (Cu), tungsten (W), aluminum (Al), or nickel (Ni).

In another embodiment, a method comprises patterning a polymer layer disposed on a substrate to define a lateral spring section; disposing a metal layer on at least a portion of the lateral spring section, the metal layer forming an antenna extending along the portion of the lateral spring section; and releasing the polymer layer and the metal layer from the substrate. In one or more aspects of these embodiments, the lateral spring section can be a semicircular spring section. The lateral spring section can extend between first and second support pads.

In one or more aspects of these embodiments, the method can comprise disposing the polymer layer on the substrate. The polymer layer can be disposed on the substrate by spin coating. The polymer layer can comprise polyimide or PDMS. The metal layer can be disposed on the polymer layer by electroplating. The metal layer can comprise a metallic thin film of copper (Cu), tungsten (W), aluminum (Al), or nickel (Ni).

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 1A includes images of a copper layer disposed on a polydimethylsiloxane (PDMS) layer, in accordance with various embodiments of the present disclosure.

FIGS. 1B and 1C illustrate an example of a lateral spring, in accordance with various embodiments of the present disclosure.

FIG. 1D is a plot illustrating the stretchability of the lateral spring of FIGS. 1B and 1C, in accordance with various embodiments of the present disclosure.

FIGS. 2A and 2B are graphical representations illustrating an example of a stretchable antenna, in accordance with various embodiments of the present disclosure.

FIGS. 4A-4D and 5A-5D are images illustrating the stretchability and flexibility of a fabricated stretchable antenna, in accordance with various embodiments of the present disclosure.

DETAILED DESCRIPTION

Figure 3:
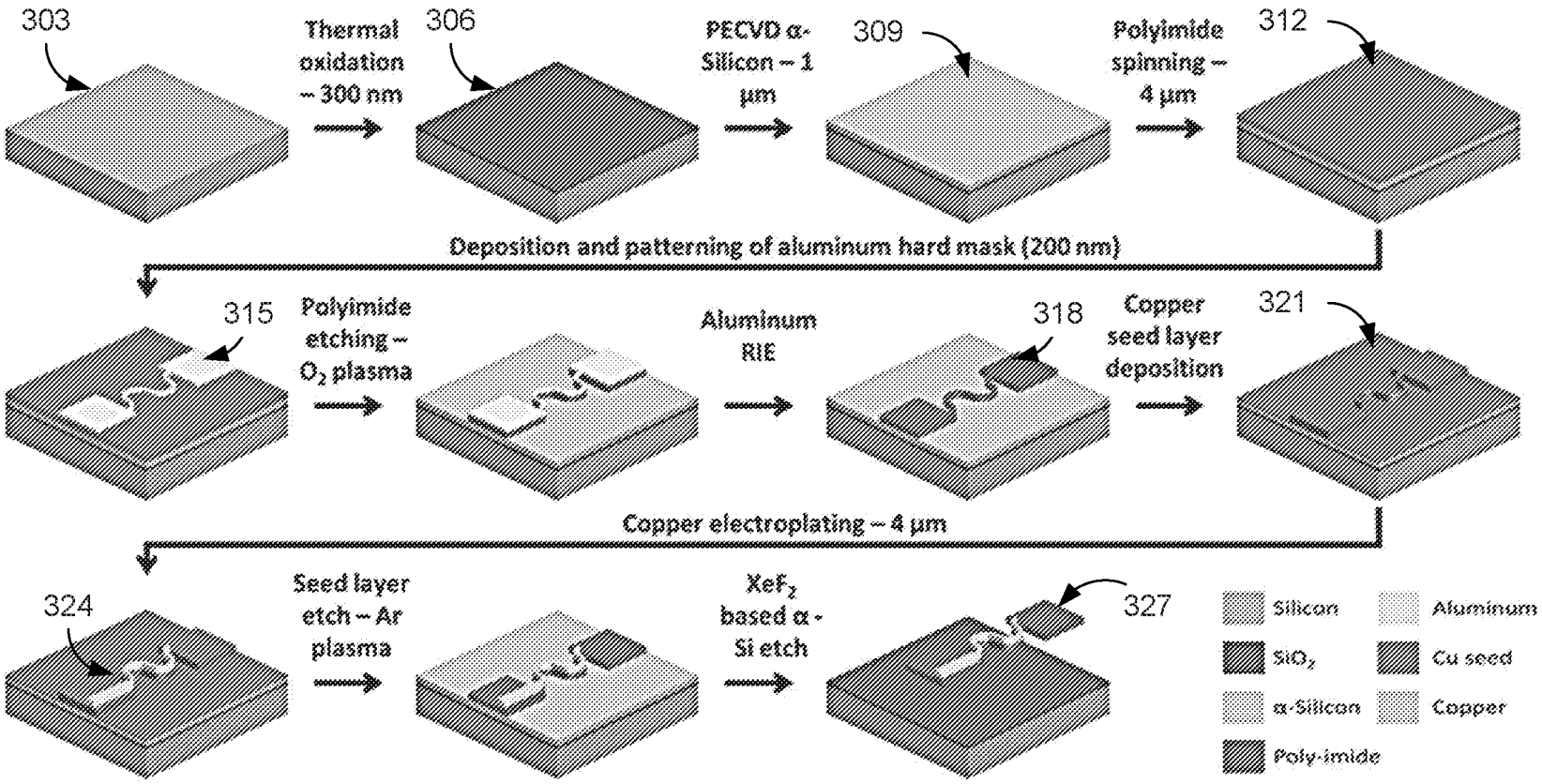
FIG. 3 illustrates an example of the fabrication of a stretchable antenna, in accordance with various embodiments of the present disclosure.

Disclosed herein are various examples related to stretchable antennas for use with flexible electronics such as, e.g., wearable electronics. Electronics that are flexible and stretchable can physically stretch to absorb the strain associated with body movement offers many advantages in wearable applications. However, a stretchable antenna which can perform far-field communications and can operate at constant frequency, such that physical shape modulation will not compromise its functionality, is yet to be realized. Here, stretchable antennas are presented, with an example of the compact antenna design tested to evaluate its data communication capabilities. Reference will now be made in detail to the description of the embodiments as illustrated in the drawings, wherein like reference numbers indicate like parts throughout the several views.

Flexible and stretchable electronics offer opportunities for a world of wearable electronics. These gadgets can be used for myriad applications such as advanced healthcare, monitoring of body's vital signs, in situ drug delivery, implantable electrodes for brain machine interface, etc. Although flexible and non-stretchable electronics can be useful for applications with arbitrarily shaped static surfaces, applications on flexing body parts (e.g., elbow, finger joints, wrist, knee, ankle, etc.) the electronics need to be stretchable so as to absorb the strains associated with the movement, thus making stretchability an important aspect of this next generation of electronics. In addition to being flexible, stretchable, and conformal for their implementation on complex three dimensional (3D) structures, these electronic systems are designed with sophisticated data handling and processing capabilities.

In many applications, constant data transmission through an integrated communication system can be vital. Data communication enables applications, such as wearable healthcare devices, to communicate a user's vital signs to a smart phone, tablet or other user device and receive instructions for corrective action in real-time. This real-time processing and data storage can eliminate the need for large memory arrays to be integrated with the wearable healthcare monitoring devices, and promises to open new doors for advanced health applications such as a completely body integrated sensor/actuator network. The challenge, in this case, is to build a fully integrated system of sensors, actuators, data processing elements and far-field communication systems on a platform that is both flexible and stretchable. In this disclosure, a wearable far-field communication system is discussed.

For a communication system to be wearable, its components can be made on a flexible and stretchable platform. While the transistors used in RF circuits can be made flexible and stretchable using several techniques demonstrated earlier, the main component of the communication circuit, the antenna for far-field communication, is still a challenge. The performance of the antenna, being a radiative element with a strong dependence on the wavelength of the signal and the shape of the mounting platform, can be investigated in such applications. Previous systems using stretchable antennas radiate at different resonant frequencies due to a change in length of the antenna upon elongation. Although this may be an interesting property for tunable frequency applications, it is undesirable for the typical single frequency transmit-receive operation.

To complement these systems, a stretchable and wearable antenna that can provide a single frequency operation while flexing or stretching is disclosed. This antenna has been fabricated using a metal/polymer bilayer process and the stretchability is imparted using a lateral spring structure. The antenna was fabricated as a metal/polymer bilayer because standalone metal thin films are very malleable, and deform plastically under the application of stress. Hence, a metal thin film lateral spring structure cannot be used as a stretchable antenna, since it will only be able to undergo one stretch cycle. The polymer backing provides the restoration force which helps the spring return to its original shape after the release of the applied lateral force.

Here, an example of a stretchable antenna is presented, using a low-cost metal (e.g., copper) on a flexible polymeric platform, which functions at constant frequency of 2.45 GHz, for far-field applications. While mounted on a stretchable fabric worn by a human subject, the fabricated antenna was able to communicate at a distance of 80 m with 1.25 mW transmitted power. One example of the compact antenna design was fabricated and tested to evaluate its enhanced data communication capability in wearable electronics.

Stretchability Analysis

The metal used to fabricate the antenna was copper (Cu), since it is a common, low-cost metal with excellent conductivity and is compatible with the CMOS fabrication process. Since copper is inherently unstretchable, a twisted helical spring design was adopted to make the copper stretchable. Copper has been coupled with a polymer such as, e.g., polyimide (PI) to provide structural support as well as insulation to the antenna. One of the major concerns in designing a stretchable antenna with a metal thin film is the cracking of the metal thin film upon application of stress. This problem can be observed when a metal is deposited on a stretchable polymer base, and the polymer is stretched.

This phenomenon was verified by argon (Ar) sputtering a 600 nm layer of copper on a stretchable polydimethylsiloxane (PDMS) base. FIG. 1A shows the strip of PDMS sputtered with 600 nm of copper. The copper strip had an end-to-end resistance of 6Ω under no strain, which is shown in the image on the left. When a relatively small lateral strain of 7% was applied as shown in the center image, the end-to-end resistance went out of the measuring range of the instrument (>20 MΩ). This may be attributed to the development of cracks in the metal as shown in the image on the right.

This problem can be overcome by designing the antenna in such a way that it twists out-of-plane to relieve the stress. This design is based on a twisted helical spring structure. The basic lateral spring structure is suitable for stretchable interconnect applications. Here, the application of a lateral spring structure as a stretchable antenna is examined. The stretching mechanism (or behavior) of a semicircular lateral spring is illustrated in FIG. 1B using a simple paper model. The spring elongates in the lateral direction by twisting out of plane at particular points, which demonstrates the stretching mechanism since this out-of-plane twisting (allowing detachment from the host substrate) is clearly visible in the macro-sized model.

For a unit cell having a length l and two semicircular lobes of radius R as shown in FIG. 1B, the twisting occurs at four points as illustrated by the circles. At each point, the twist causes a 180° phase shift in the plane of the spring. Hence, after two twists, the spring plane is again normal (or aligned back) to the original direction. This is depicted using two different contrasting colors, a darker blue on one side and white on the other side. The darker blue plane is normal to the original direction after two twist points (at the center of the spring), and again at the distal end, after four twist points.

This elongated lateral spring structure can be approximated as a 3D spiral shown in FIG. 1C. The 3D model illustrates that the original circumference of the spring makes an out-of-plane helical structure. The twist points, highlighted with the dotted squares and the colors of the planes have been kept the same for resemblance. The pitch of this spiral (P) is at the final length of the elongated spring, and hence provides the stretchability of a lateral spring structure. The initial circumference (C) of the lateral spring is twisted into the length of the 3D spiral in FIG. 1C. The spiral can be easily described in a cylindrical coordinate system with a constant radial coordinate, and varying θ and z coordinates. For a given pitch P, the theta coordinate (θ) goes from 0 to 2π. Hence, the z coordinate can be considered as a function of theta (θ) as given by:

$$z = \frac{P\theta}{2\pi}. \tag{1}$$

Hence, the 3D spiral is the locus of the point (r,θ,Pθ/2π). This general point can be converted into the Cartesian coordinate system using a simple conversion as (r cos θ, r sin θ, Pθ/2π). For a small change in theta (dθ), the change in the other coordinates can be obtained. This change can be used to calculate the distance between the two points as:

$$dL = \sqrt{(dx)^2 + (dy)^2 + (dz)^2}, \tag{2}$$

$$dL = \sqrt{(dr\cos\theta)^2 + (dr\sin\theta)^2 + \left(d\left(\frac{P\theta}{2\pi}\right)\right)^2}, \tag{3}$$

$$dL = \sqrt{(r\sin\theta)^2(d\theta)^2 + (r\cos\theta)^2(d\theta)^2 + \left(\left(\frac{P}{2\pi}\right)\right)^2(d\theta)^2}, \tag{4}$$

$$dL = \sqrt{r^2 + \left(\left(\frac{P}{2\pi}\right)\right)^2}\, d\theta. \tag{5}$$

The integration of this distance over the complete rotations can give the circumference of the original lateral spring. In general, if the lateral spring has n twist points, the total length is given by:

$$C = \int_0^{n\pi} \sqrt{r^2 + \left(\left(\frac{P}{2\pi}\right)\right)^2}\, d\theta, \tag{6}$$

$$C = n\sqrt{(\pi r)^2 + \left(\frac{P}{2}\right)^2}. \tag{7}$$

Further, the diameter of the 3D spiral is the width of the original lateral spring (w). Hence, the pitch can be expressed in terms of the known parameters as:

$$P^2 = \left(\frac{2C}{n}\right)^2 - (\pi w)^2. \tag{8}$$

The stretchability (ε) is given by the ratio of the distance traveled by the 3D spiral in z-direction with respect to the initial lateral length of the spring (l):

$$\varepsilon = \frac{nP}{2l}, \tag{9}$$

$$\varepsilon = \frac{nP}{2l}\sqrt{\left(\frac{2C}{n}\right)^2 - (\pi w)^2}, \tag{10}$$

$$\varepsilon = \frac{1}{l}\sqrt{C^2 - \left(\frac{\pi n w}{2}\right)^2}. \tag{11}$$

This generalized expression gives the maximum stretchability of a lateral spring due to its design. This analysis assumes that the materials involved are inherently unstretchable. If there is inherent stretching in the materials due to stress, it will be over and above the stretching calculated using this expression.

From Equation (11), it can be observed that if the width (w) of the spring is very small, the equation can be simplified to ε=C/l. This is expected since a lateral spring with an infinitely small width can be approximated as a string that can stretch up to its original circumference. The addition of width necessitates the structure to twist which reduces the maximum stretchability. In the case of the simple lateral spring shown in FIG. 1B, the circumference is 2πR and the initial length, l=4R, where R is the radius of the lobes of the spring. Also, the number of twists is four as seen in the extended paper model in FIG. 1B. Hence, the stretchability in this case can be obtained as:

$$\varepsilon = \frac{1}{4R}\sqrt{(2\pi R)^2 - \left(\frac{4\pi w}{2}\right)^2}, \tag{12}$$

$$\varepsilon = \frac{\pi}{2}\sqrt{1 - \left(\frac{w}{R}\right)^2}. \tag{13}$$

This simple equation describes the behavior of circular lateral springs made using inherently nonstretchable materials. It shows that the stretchability is only dependent on the ratio of the width of the spring to the radius of the lobes. FIG. 1D illustrates the dependence of the stretchability with respect to the w/R ratio. The upper limit of the shaded area is the maximum stretchability by design as calculated using Equation (13). As can be seen, the maximum stretchability that can be obtained for a circular lateral spring design is 57.1%, when the width of the spring is negligible compared to its radius. Indeed, for the analysis to hold, the lateral springs need to twist out-of-plane. Hence, the width of the spring is generally less compared to the lobe radius.

In case of the stretchable antennas fabricated in this work, the w/R ratio was 0.4, hence the maximum stretchability expected was 43%. The "X" in FIG. 1D marks the value of the stretchability that was experimentally obtained for the fabricated antennas. This maximum stretchability only applies in the case of naturally unstretchable metals such as, e.g., copper (Cu), tungsten (W), aluminum (Al), nickel (Ni). However, certain conductive materials, such as carbon (C), copper (Cu), and silver (Ag) nanowire dispersions and composites, have been shown to be inherently stretchable due to their structure. This stretchability is over and above the one obtained by design as derived in this analysis.

Hence, it can be added to the stretchability by design to obtain the total maximum stretchability. The stretchability can be further improved by pre-straining the design.

Antenna Design

FIG. 2A shows an example of a design for a stretchable monopole antenna 203 with feed and support structures. Based on this analysis, the antenna 203 has the form of a semicircular spring supported by two conducting polymer pads 206. As previously discussed, when a force is applied along on the lateral direction, the spring structure twists at certain points, allowing the antenna 203 to stretch. As a result, the length of the antenna 203 does not physically increase during any point of stretching. The elongation is only obtained due to the restructuring of the lateral spring. This has two important consequences on the antenna performance. First, the metal does not crack since it is at no point under actual physical elongation. This helps maintain the electrical performance of the metal. Second, the operational frequency of wire antennas is typically inversely proportional to their lengths. The geometry of the antenna 203 also has some effect on the resonant frequency, however because a simple monopole antenna which only stretches 30% is being used, the effect of the changing geometry is not significant. In this example, the monopole antenna 203 was designed to operate at 2.45 GHz for Wi-Fi applications (IEEE 802.11). This is one of the most commonly used Wi-Fi frequencies which can be a convenient option for data communication in wearable systems.

The antenna 203 was initially simulated using the Ansys High Frequency Structure Simulator (HFSS) to optimize its length for the best impedance and radiation performance. These simulations showed that for operation at 2.45 GHz, the antenna length should be 30 mm which corresponds to quarter of a wavelength as is expected from a monopole antenna. The width (w) of the antenna 203 was kept at 1 mm, since releasing a larger structure without release holes would not have been possible in the fabrication phase. For radio frequency (RF) excitation, the antenna 203 was connected to a microstrip feed line 209 of 50Ω impedance fabricated on an FR-4 substrate. The rigid FR-4 substrate was used for testing purposes only. In reality, the antenna 203 can be excited using an IC based driving circuit mounted on a flexible substrate. This value of characteristic impedance was used since it is a standard for most of the RF measurement instruments. After connecting the antenna 203 to the feed line 209, it was initially simulated in air to observe its impedance and radiation performance.

FIG. 2B shows an example of the simulation model used to define the stretchable antenna 203 on fabric 212. Once the optimization in air was complete, the model was simulated with a flexible and stretchable textile fabric 212 underneath as illustrated in FIG. 2B. This was done to simulate the effects of the flexible and stretchable communication system being integrated on human clothing. The thickness of the fabric 212 was about 300 μm and its dielectric constant was measured to be 1.4. Using these properties of the fabric 212, it was observed that the performance of the antenna 203 did not vary from the original design when it was simulated with the fabric 212 underneath. With all the dimensions discussed above, the fabrication of the antenna 203 proceeded. The simulated optimized performance of the antenna 203 will be discussed with the measured results.

Fabrication Process

An example of a process flow to fabricate a stretchable antenna 203 is schematically represented in FIG. 3. A silicon dioxide ($SiO_2$) layer (e.g., about 300 nm) can be formed on a silicon wafer 303 (e.g., a 4" wafer) through, e.g., thermal oxidization. An amorphous silicon (a-Si or α-Si) layer (e.g., about 1 μm thick) can be deposited on the oxidized silicon wafer 306 as a sacrificial layer 309 using, e.g., plasma enhanced chemical vapor deposition (PECVD). A polymer layer 312 (e.g., polyimide about 4 μm thick) can then be spun onto the sacrificial layer 309. The polymer layer 312 can be patterned to define the shape of a lateral spring section using, e.g., deposition of an aluminum hard mask 315 (e.g., about 200 nm) and etching with $O_2$ plasma. The mask 315 can then be removed using, e.g., reactive ion etching (RIE), exposing the patterned polymer layer 318.

A metal layer can be disposed on the patterned polymer layer 318 to form an antenna and/or a feed line. For example, a seed layer 321 for copper growth can first be deposited on the sacrificial layer 309 and patterned polymer layer 318, followed by selective copper electroplating (e.g., about 4 μm thick) to form the metal layer 324 along at least a portion of the lateral spring section. The metal layer 324 can comprise the antenna 203 and/or the feed line 209 (FIG. 2A). The metal layer can be formed using other appropriate metals such as, e.g., tungsten (W), aluminum (Al), or nickel (Ni). The seed layer 321 can then be removed by, e.g., RIE (with, e.g., argon plasma) and the sacrificial layer 309 can be etched isotropically using, e.g., xenon difluoride ($XeF_2$) to release the antenna structure 327 from the oxidized Si wafer 306.

Figures 4A, 4B, 4C, 4D:
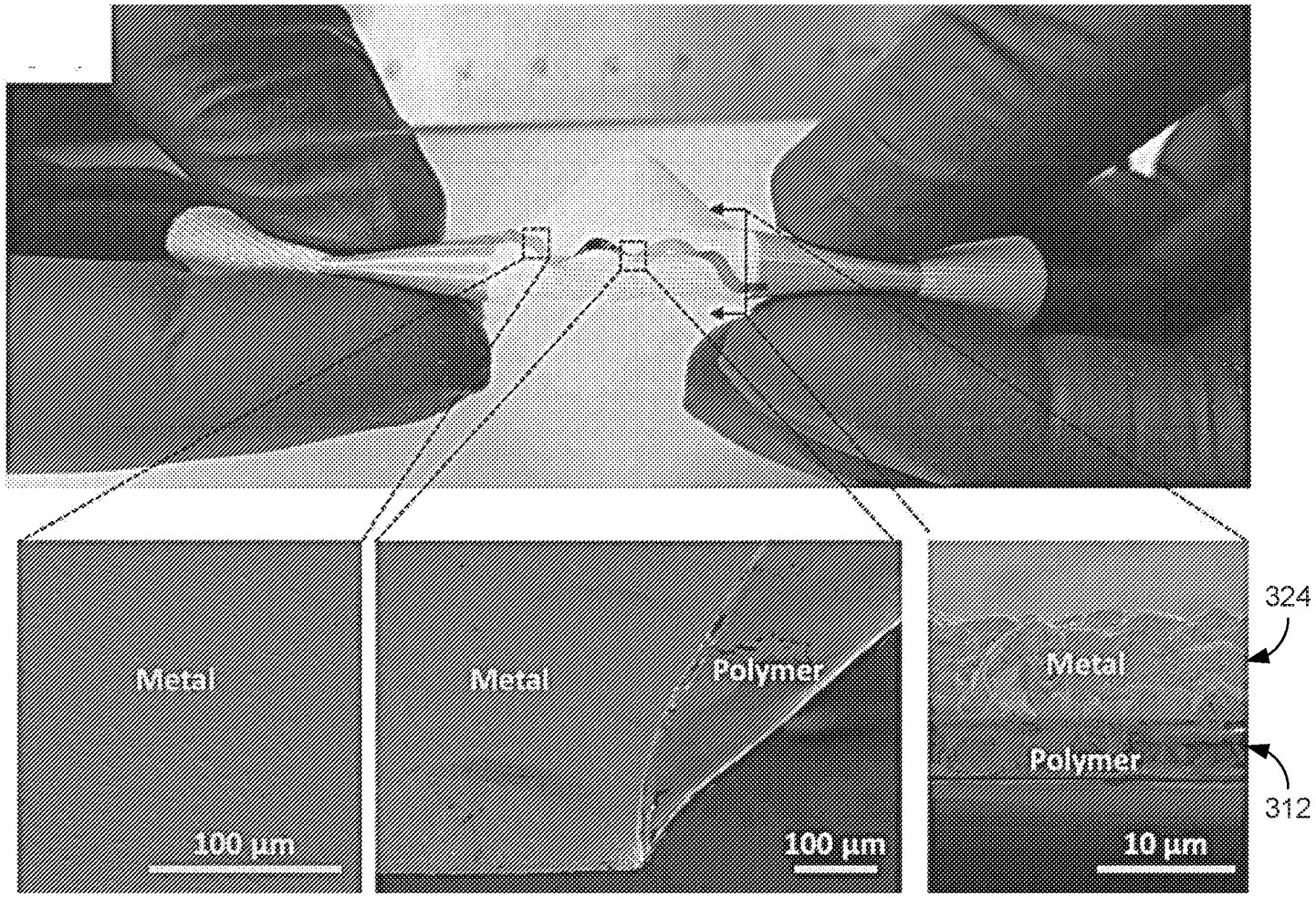

Referring to FIGS. 4A and 4B-4D, shown are optical and scanning electron microscopy (SEM) images, respectively, of the fabricated antenna. FIG. 4B is a top view showing the metal surface of the fabricated antenna. FIG. 4C shows the antenna twisting at the apex point. The SEM images of FIGS. 4B and 4C were taken for the stretched antenna and show that the metal surface has no cracks due to stretching, even when strained up to 30%. FIG. 4D is a cross-section SEM image showing the metal layer 324 grown on top of the polymer layer 312.

Since the fabricated antenna was designed for wearable electronics applications, evaluation of its performance when attached to a fabric is important. The antenna's stretching, flexing, mechanical properties and electrical characteristics were characterized while it was attached to a stretchable fabric (typically used in Spandex). This was done to showcase the use of the stretchable antenna to monitor and communicate body movements and vital signs while being worn. FIG. 5A includes optical images illustrating the elongation of the lateral spring antenna at 0%, 15% and 30%. The antenna on fabric can be strained, bent, flexed, twisted, stretched, curled, and crumpled without physical damage as shown in FIG. 5B. When the antenna is attached on top of clothing such as, e.g., a sports T-shirt (used by athletes) made of stretchable fabric, it can survive the stretching, flexing, and twisting associated with basic body movements as illustrated in FIGS. 5C and 5D.

As a result, the antenna can be connected to healthcare monitoring sensors on the body and the data can be wirelessly transmitted to a receiver such as a smart phone for storage or processing. This allows athletes to measure parameters such as body temperature, oxygen saturation, and blood pressure in real-time during workouts or other activities. Further, healthcare professionals can use this technology to constantly monitor their patients' vital signs wirelessly. With the collection, processing, and storage of a large amount of data, this technology can allow big data analysis of healthcare data.

Results and Evaluation

Figure 6B:
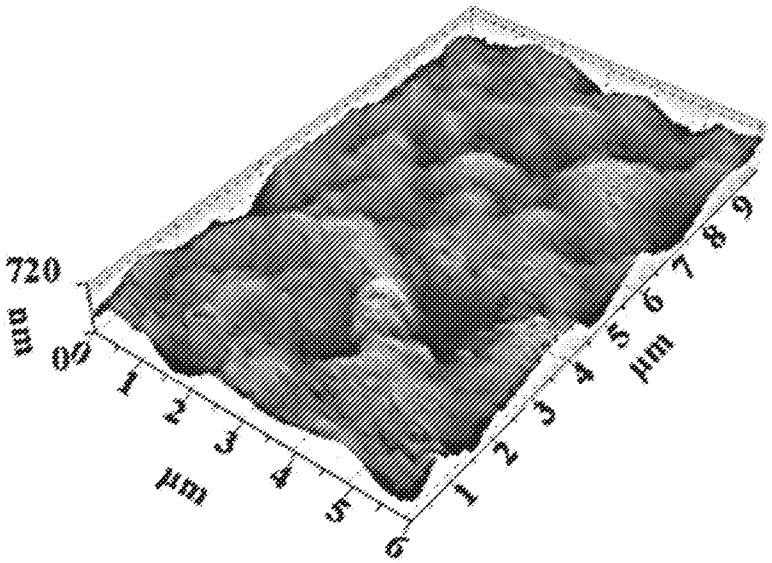
FIGS. 6A and 6B illustrate characteristics of the fabricated stretchable antenna of FIGS. 4A-4D and 5A-5D, in accordance with various embodiments of the present disclosure.
Figure 6A:
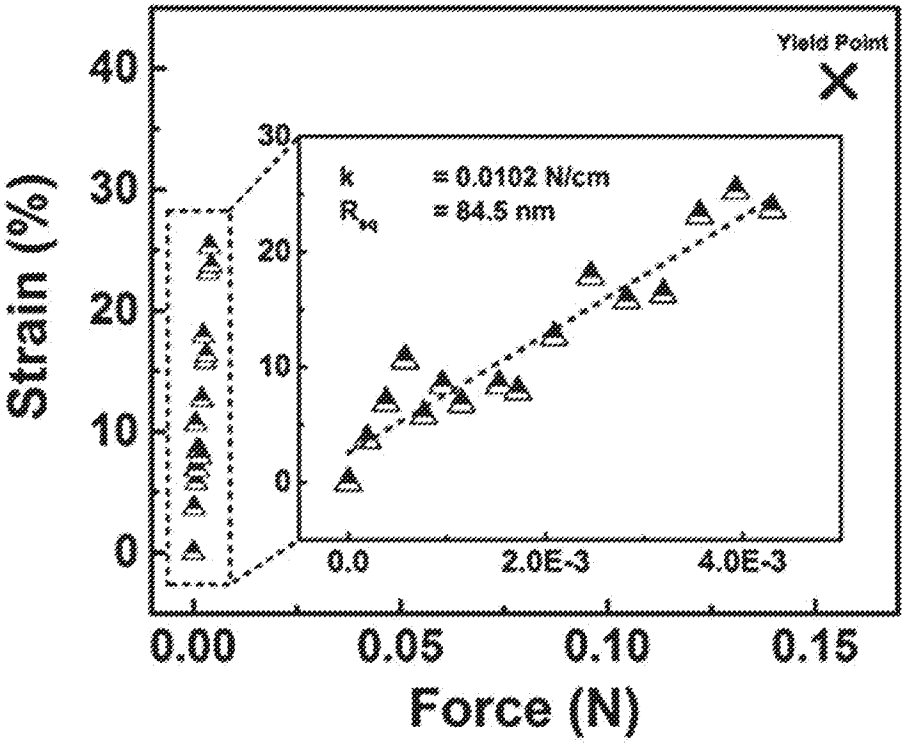

The mechanical performance of the fabricated antenna (without fabric) is illustrated in FIG. 6A. The stress-strain curve of FIG. 6A shows that the antenna behaves as a mechanical spring with a spring constant, k=0.01 N $cm^{-1}$. The maximum elongation for the antenna was 39%, which is very close to the theoretical prediction of 43% obtained from the analysis. At this maximum elongation, the yield force was observed to be 0.15 N (15 MPa), with the yield point for the antenna reported as 0.155 N. However, the elastic limit for the antenna was around 30%. The antenna has enough mechanical strength to be handled manually without the need of any support structure.

For further strengthening, the antenna can be packaged using a foam cavity structure to provide adequate space above and below the antenna plane for out-of-plane twisting. The stress-strain curve obtained for the antenna in the elastic region is elaborated in the inset of FIG. 6A. Based on the linear fit for the measured points, the spring constant for the lateral springs was calculated to be k=0.0102 N $cm^{-1}$. The metal layer 324 of copper was grown on polymer layer 312 using electroplating, which generally leads to a rough thin film surface as shown in the SEM image of FIG. 4D. The surface roughness of the as-grown copper thin film was evaluated using atomic force microscopy (AFM). The surface morphology of the electroplated copper is shown in FIG. 6B. The RMS surface roughness for the grown copper film was found to be 84.5 nm.

Figure 7A:
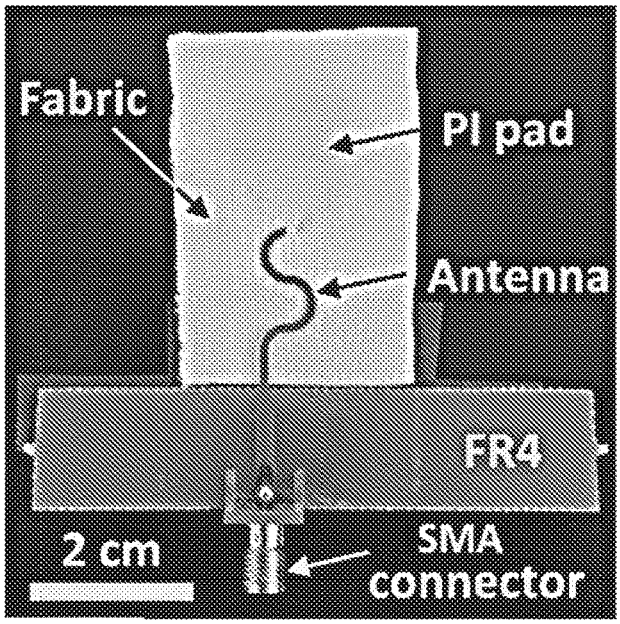
FIG. 7A is an image of a fabricated stretchable antenna, in accordance with various embodiments of the present disclosure.
Figure 7B:
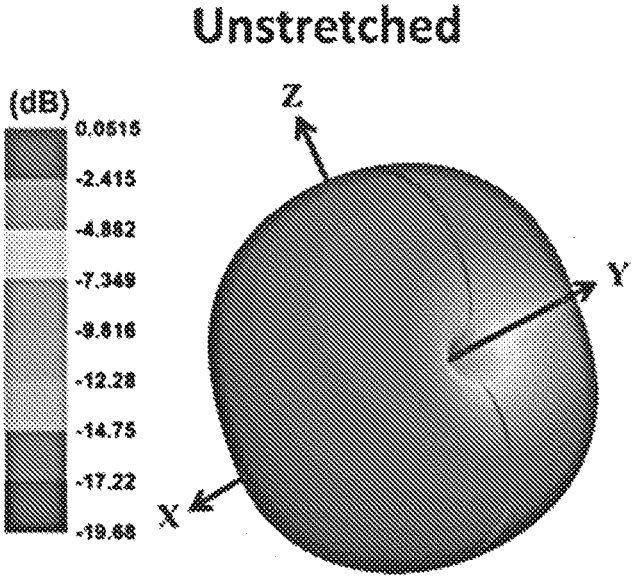
FIGS. 7B and 7C are measured 3D radiation patterns of the fabricated stretchable antenna of FIG. 7A, in accordance with various embodiments of the present disclosure.
Figure 7C:
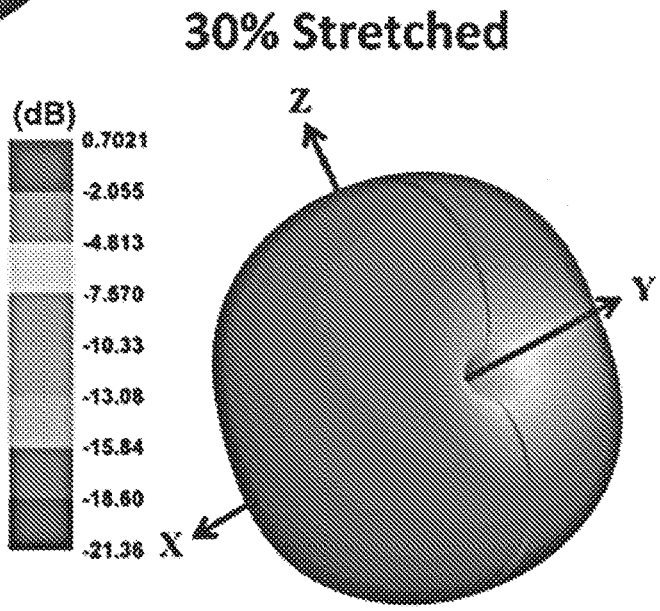

Once the antenna was fabricated, it was characterized for its impedance and radiation performance. For RF excitation, a SMA (SubMiniature version A) connector was soldered onto the substrate, such that its pin makes a contact with the feed line while the body of the connector was grounded. FIG. 7A is an optical image of the stretchable antenna on fabric with FR-4 and the SMA connector attached. It was important to characterize the electrical properties of the fabricated antenna while attached to a piece of cloth, since the final communication system is proposed to be wearable and integrated onto textile fabrics. To this effect, the antenna was taped to a stretchable fabric to characterize the antenna in its presence. Hence, the effect of the cloth on the antenna performance is built into the presented results. The stretchable antenna was measured for its impedance performance using Agilent's PNA (Performance Network Analyzer) N5232A, while the radiation pattern of the antenna was measured using Satimo's Star Lab (Anechoic Chamber). The measured 3D radiation patterns of FIGS. 7B and 7C demonstrate an omnidirectional behavior for the unstretched and 30% stretched antenna, which is expected for a monopole antenna. The 3D radiation patterns show no significant change between the unstretched and stretched configurations.

Figures 8A, 8B:
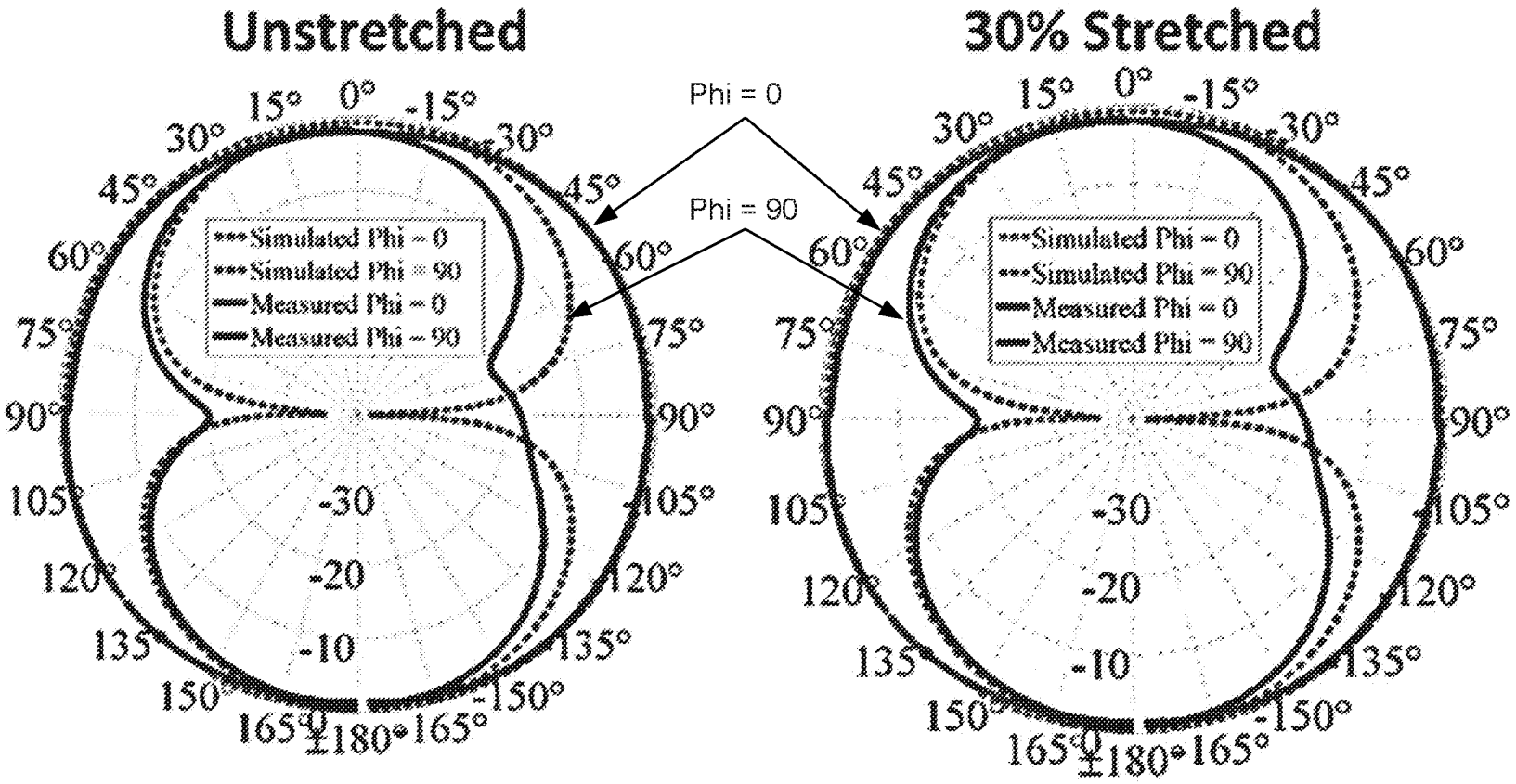
FIGS. 8A-8H illustrate characteristics of the fabricated stretchable antenna of FIG. 7A, in accordance with various embodiments of the present disclosure.

Referring to FIGS. 8A-8D, shown are examples of 2D polar plots of the simulated and measured radiation performance of the stretchable antenna under various conditions. The radiation patterns show that there is a good agreement between the simulated and measured radiation performance. FIGS. 8A and 8B compare the performance between unstretched and 30% stretched cases, respectively. The H plane (XZ plane) of the antenna shows a constant gain in the complete elevation plane while the E plane (YZ plane) has nulls at $\theta=\pm 90°$, for both the unstretched and stretched cases of FIGS. 8A and 8B. A measured gain of 0.05 dB was achieved from the antenna in the unstretched case, which changed to 0.7 dB in the stretched case.

Figure 8D:
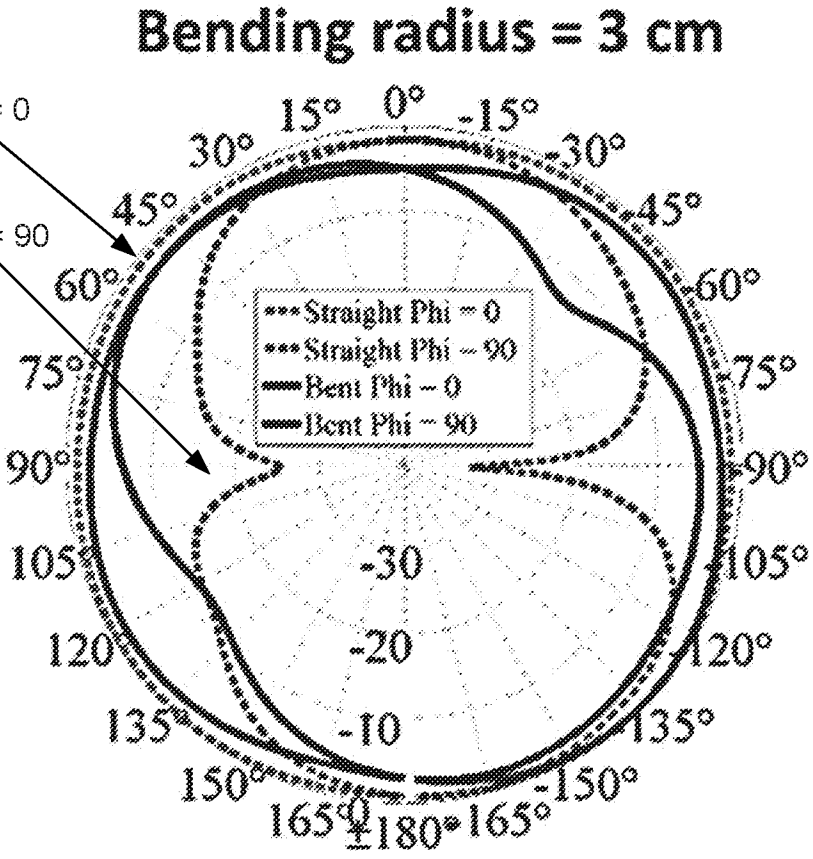
Figure 8C:
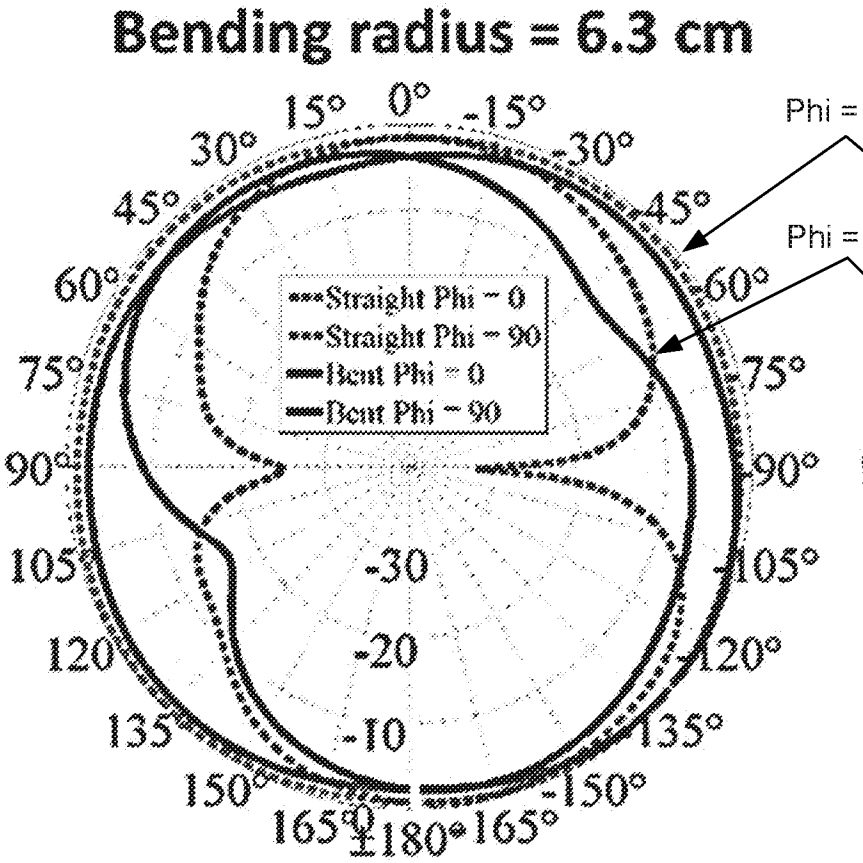

Another aspect studied for the stretchable antenna is the effect on its performance when it is bent. To do this, two cylinders with radii of 6.3 cm and 3 cm were used for the antenna characterization. The cylinders were made using packing foam material which has a dielectric constant that very close to air ($\varepsilon_r \approx 1$), and therefore would not affect the antenna characteristics. The 2D polar plots of FIGS. 8C and 8D illustrate the performance of the antenna under the two different bending strains. When compared to the plot of FIG. 8A, it can be seen that the radiation patterns have considerable similarity before and after the bending. Moreover the gain of the antenna remains preserved, independent of the bending radius. Hence, it can be concluded that the antenna shows flexibility in addition to being stretchable.

Figure 8E:
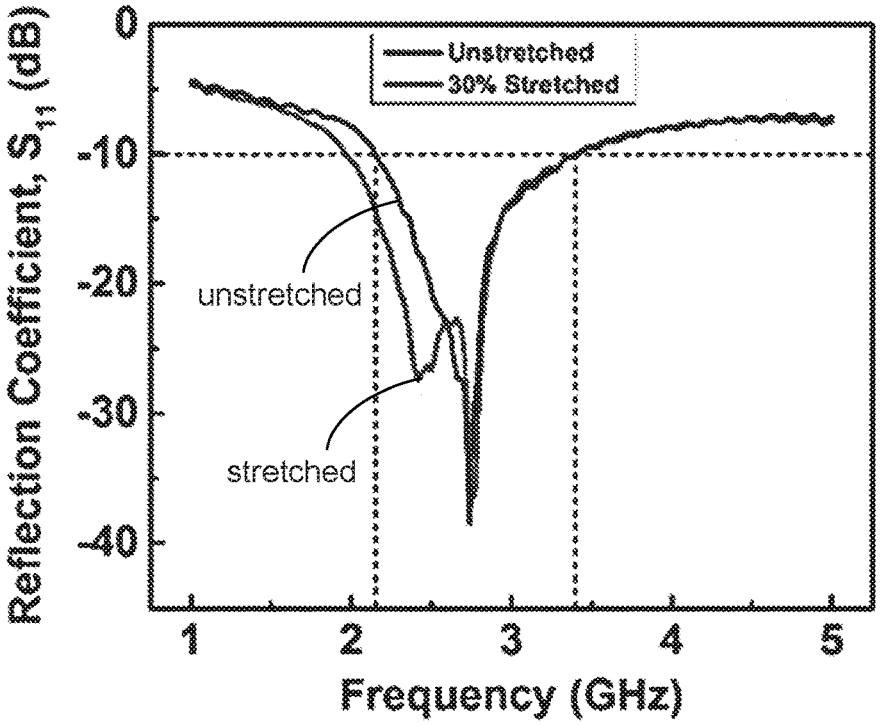

Further, for the continuity of the communication channel, it is important that the operation frequency remains the same throughout its lifetime in any strain condition. To study this, the reflection coefficients ($S_{11}$) of the stretchable antenna at various strain values were plotted in FIG. 8E. It can be observed that the antenna demonstrated very good impedance matching for both the stretched and unstretched cases ($S_{11}<-10$ dB at 2.45 GHz). Also, the impedance bandwidth of the antenna was 51.1% and 53.4% for the unstretched and stretched case, respectively. The stretchable antenna retains its essential properties on stretching, and can be effective in RF communication while being stretched. Thus, the directionality, frequency, and bandwidth remain substantially constant with the application of strain and bending.

Figure 8F:
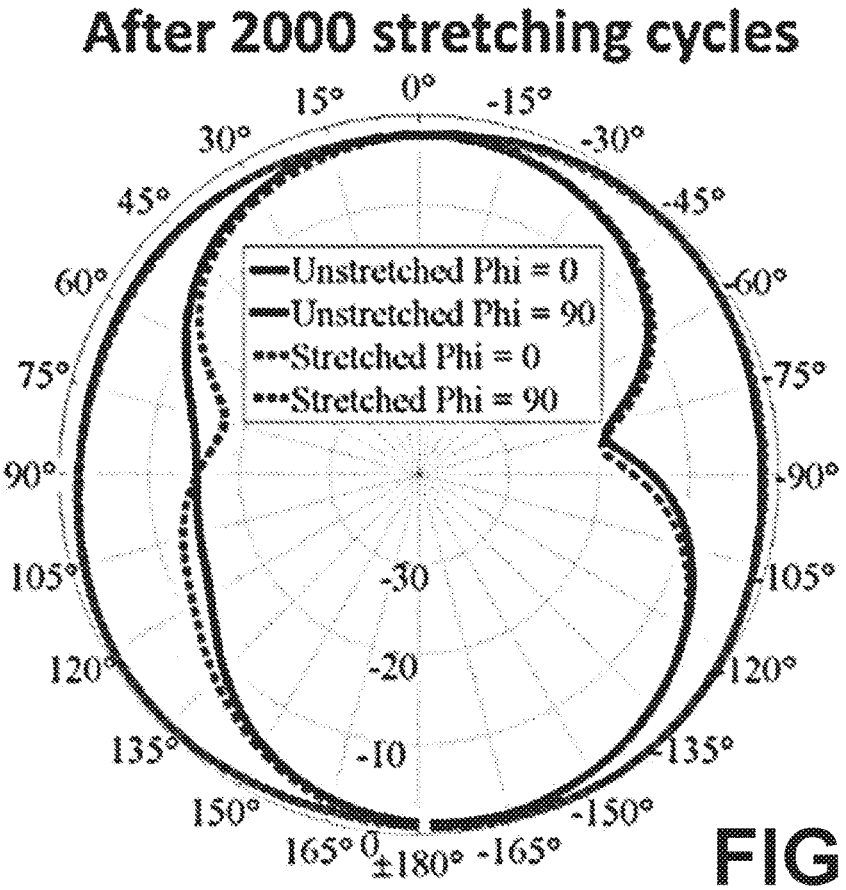
Figure 8G:
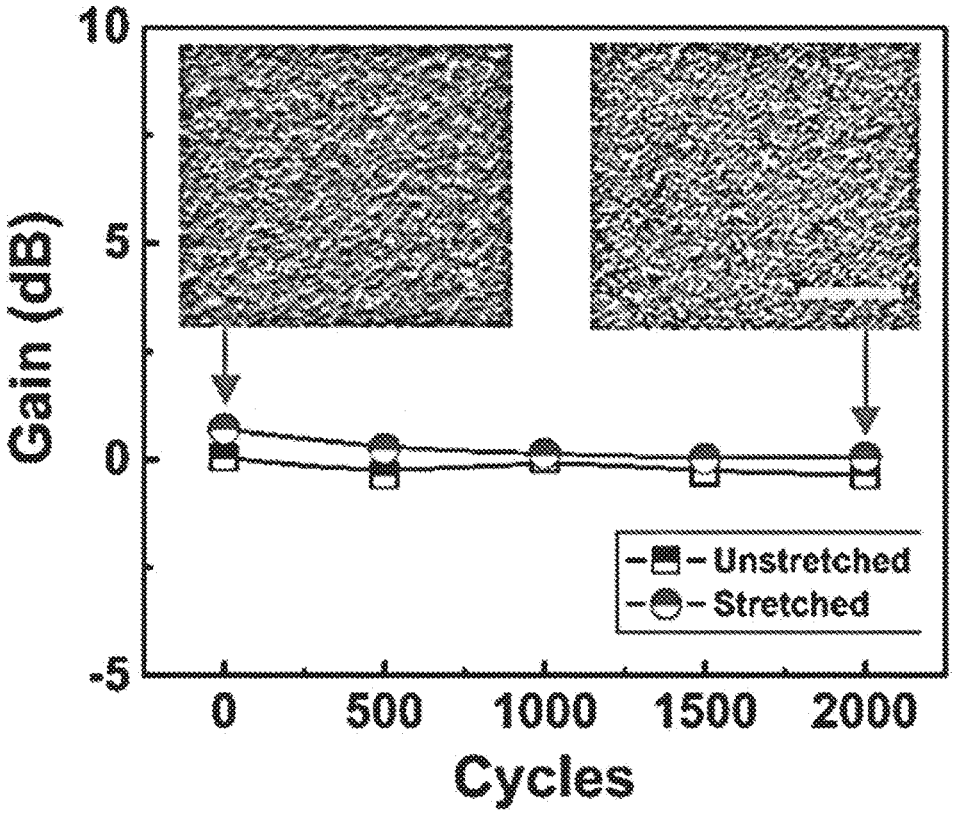
Figure 8H:
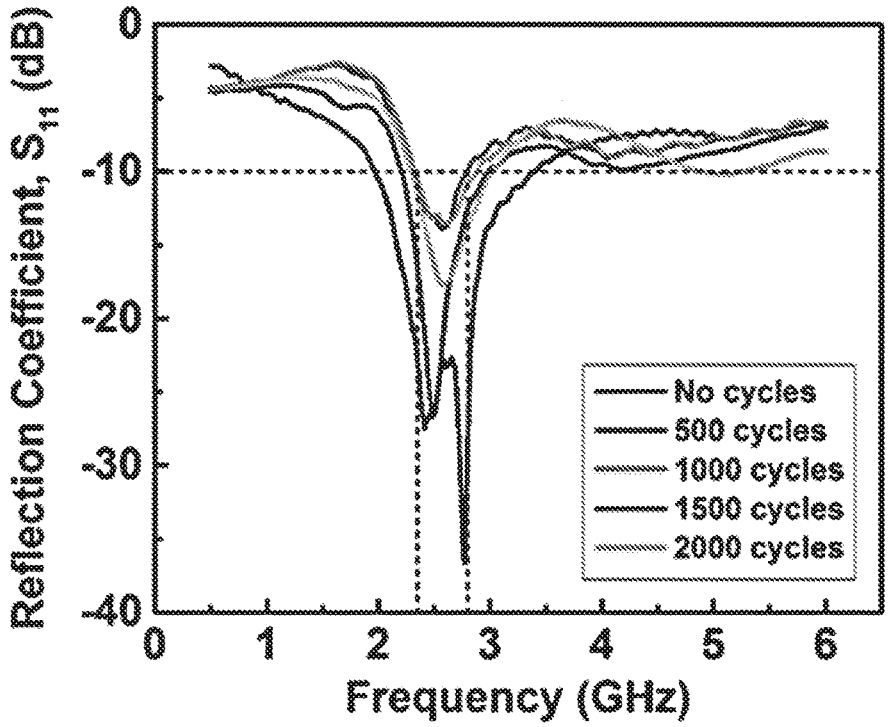

For a robust wearable communication device, it is important that the antenna survives several thousand cycles of strain. The stretchable antenna was tested over 2000 cycles for up to 30% strain. The polar plot of the radiation pattern of the antenna after cycling is shown in FIG. 8F. It can be seen that there is no marked difference in the gain and radiation patterns from the initial unstretched case. The stretchable antenna, even after 2000 cycles of stretching, maintained an omnidirectional radiation pattern. As shown in FIG. 8G, the gain of the stretchable antenna was retained over the strain cycles in addition to its radiation pattern. Furthermore, the reflection coefficient plot of FIG. 8H illustrates that the operation frequency and bandwidth ($S_{11}<-10$ dB at 2.45 GHz) of the antenna remained unchanged over the 2000 stretching cycles. The top view SEM images in FIG. 8G were taken before and after 2000 strain cycles, and show that the copper thin film does not develop cracks due to straining. The SEMs were taken (with a scale of 40 μm) for 20% strained antennas. The strain cycle test took a total of three weeks to complete. Hence, this test illustrates that the copper antenna can survive in the ambient conditions for extended periods of time and retain its electrical properties during continued usage.

Far-Field Communication

Figure 9A:
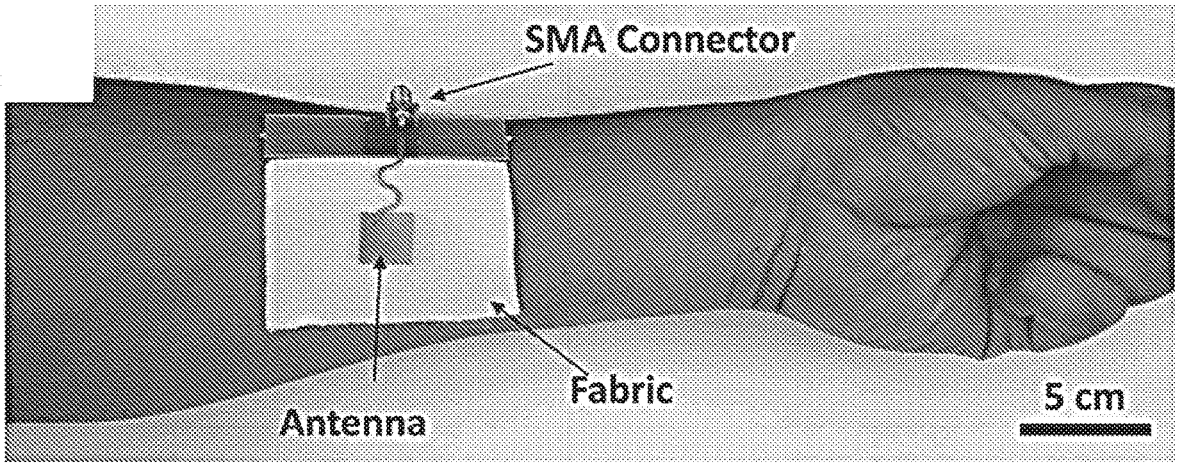
FIG. 9A is an image of the fabricated stretchable antenna of FIG. 7A positioned on a human arm, in accordance with various embodiments of the present disclosure.
Figure 9B:
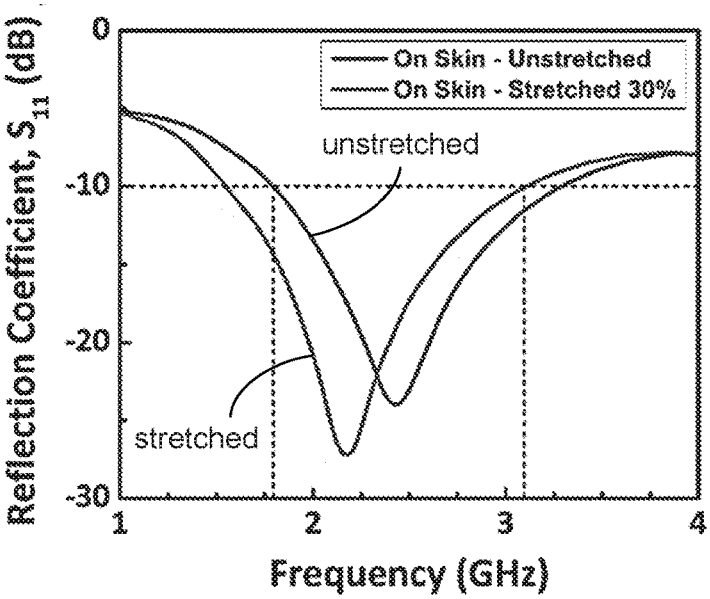
FIGS. 9B-9D compare characteristics of the fabricated stretchable antenna of FIG. 7A before and after positioning on the human arm, in accordance with various embodiments of the present disclosure.

Since the loading of the antenna by human tissue could increase the losses and cause a shift in the resonant frequency of the antenna, it was important to investigate the performance of the antenna under practical application conditions. As shown in FIG. 9A, the antenna was mounted on the arm of a consenting human subject using double sided Scotch tape, to emulate the exact condition of application of the wearable antenna. A piece of cloth was kept as an intermediate layer between the antenna and the human body, as would be the case for the end user. The reflection coefficient of the antenna was measured for this scenario showing good match at 2.45 GHz as illustrated in the $S_{11}$ plot of FIG. 9B. To measure the radiation pattern of the antenna mounted on the human arm, two identical transceivers (Smart RF05 of Texas Instruments) were used. The boards contained a CC2530 transceiver chip, which was programmed to work as a transmitter at 2.45 GHz on one board, while the chip on the other board was programmed to operate as a receiver. The stretchable antenna under test was connected to the module working as the transmitter while the receiver module had a monopole antenna provided by the manufacturer connected to it.

Figure 9C:
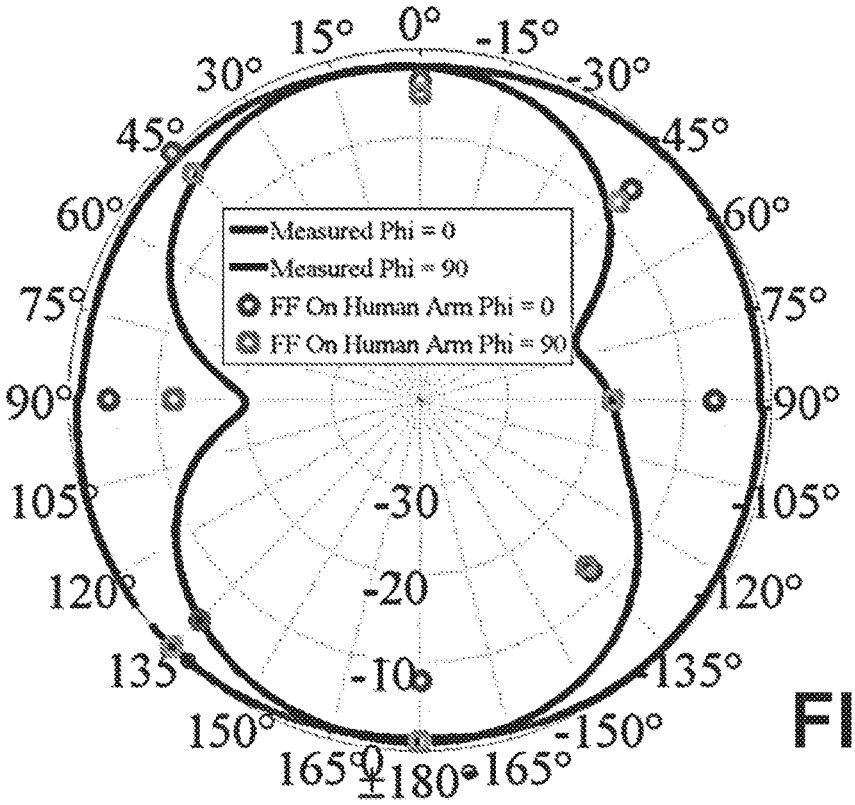

Using this set up, both H plane and E plane of the antenna were measured by rotating the receiver around the transmitter which was kept stationary at a point. A variation of 10 dB was observed in the power level received from the transmitter. This kind of variation is expected in an open environment due to the reflections from the surroundings present around the measurement area. These variations were averaged out to plot them along with the radiation pattern of the antenna measured inside the anechoic chamber. FIG. 9C shows the polar plot of the radiation pattern of the antenna on the human arm. It can be seen that a good match has been obtained between the two measurements which shows that the antenna is suitable for wearable applications which is the target of this design.

Figure 9D:
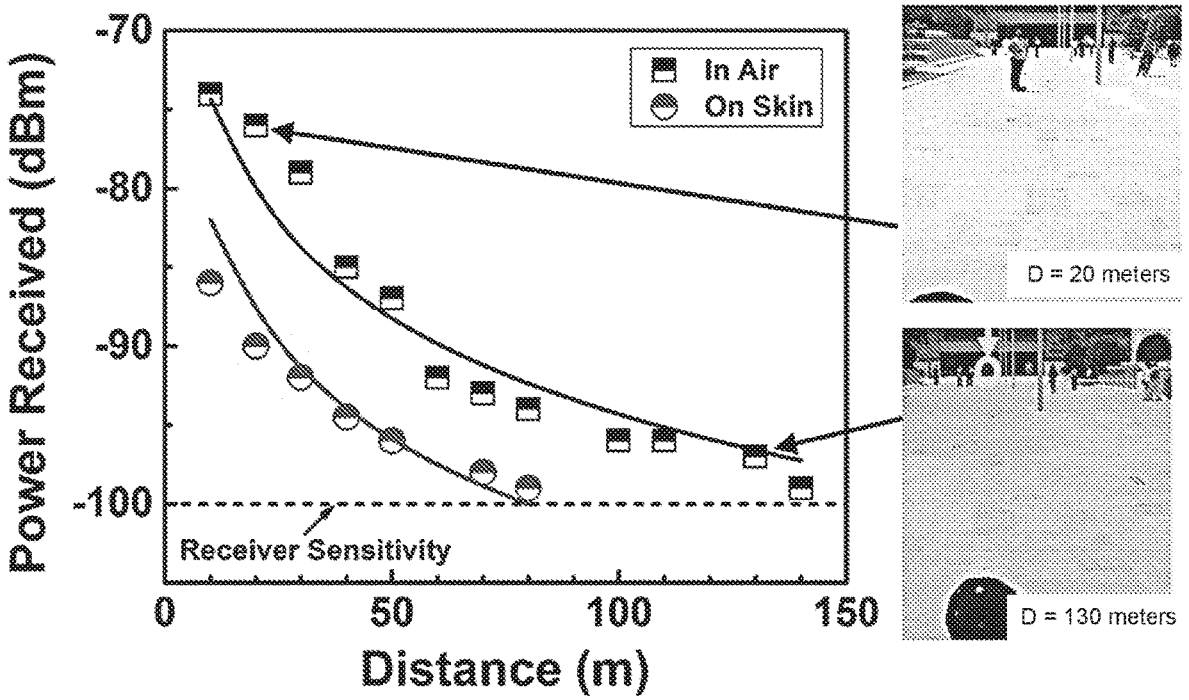

Once the antenna had been measured for its impedance and radiation characteristics, it was used in a communication system operating at 2.45 GHz to carry out range measurements. For this purpose, two SmartRF05 evaluation boards of Texas Instruments were again used as transmitter and receiver. The transmitter board was integrated with the stretchable antenna, while the receiver board had a simple monopole antenna integrated with it. The CC2530 chip provided a maximum transmitted RF power of 1 dBm (1.25 mW), while the receiver was programmed for −100 dBm sensitivity. This test was conducted in an open area on the university campus to simulate real life operating conditions. Referring to FIG. 9D, shown is a plot illustrating the relationship between the received power and the distance between the transmitter and the receiver. The data points are the experimental values of power received by the receiver board, while the lines indicate the expected variation in received power versus distance according to the Friis transmission equation.

From this set up, it can be seen that the transmitter can communicate well for a distance of up to 140 m (across about one and half soccer fields) while being in the air. If the transmitted power is increased to 10 dBm (10 mW), which can be easily achieved in Wi-Fi transmitters as per IEEE Standard 802.11, then the maximum range can be increased to 394 m. As a final step, the same range measurements were done with the proposed antenna design mounted on a human arm and connected to the transmitter while the receiver set up was the same. It was observed that when the antenna was mounted on the human arm the maximum distance or range values were reduced to 80 m, which is still good for the targeted applications. Again, if the transmitter power can be increased to 10 dBm then this range value would increase to 225 m for the antenna mounted on a human body. For all these measurements, the receiver sensitivity was kept constant at −100 dBm.

A comprehensive analysis of a flexible and stretchable copper antenna for far-field communication (e.g., up to 80 m while mounted on a stretchable fabric and worn by a human subject), which maintains its properties during stretching, bending and strain cycles, has been presented. The stretchable antenna was designed using a metal/polymer thin film bilayer and lateral spring structure. Copper was used for fabrication of the antenna since it is a common, low-cost, CMOS compatible metal, however other suitable metals may be utilized. The gain for the fabricated antenna was close to 0 dB for both stretched and unstretched cases, and after 2000 stretching cycles. The stretchable antenna retained its essential properties such as gain, radiation pattern, directionality, operation frequency and bandwidth for up to 30% strain and for 2000 cycles of strain. The antenna communicated in the 2.45 GHz Wi-Fi band under any strain condition (up to 30%), thus paving way for wearable electronics to communicate data reliably over a long range. In real life operating conditions, the antenna on human arm can communicate up to a distance of 80 m with 1.25 mW transmitted power.

Fabrication Notes

Copper/PDMS Strip: A 10:1 mixture of base and curer (Sylgard 184 Silicone Elastomer Kit, Dow Corning) was made in a plastic beaker and spun on a wafer at 500 rpm. The PDMS was cured at 100° C. for 20 min before deposition of 600 nm of copper using argon plasma sputtering (25 sccm, 5 mTorr, 400 W). The PDMS was removed from the substrate and cut into a strip to perform the experiment.

Stretchable Antennas: The fabrication process for the stretchable antennas started with 4" silicon wafers thermally oxidized using a dry-wet-dry oxidation cycle to obtain 300 nm of $SiO_2$. A 1 μm layer of amorphous silicon was deposited using plasma enhanced chemical vapor deposition (PECVD) at 250° C. for 25 min. This was followed by spinning a 4 μm layer of polyimide (PI2611, HD Microsystems) at 4000 rpm for 60 s. The polyimide (PI) was cured first at 90° C. for 90 s, then at 150° C. for 90 s and finally at 350° C. for 30 min. A 200 nm layer of aluminum was deposited on top of PI as hard mask using argon plasma sputtering (25 sccm Ar, 5 mTorr, 400 W, 600 s). The aluminum was patterned using AZ1512 photoresist (40 mJ $cm^{-2}$) and etched using reactive ion etching (RIE) at 80° C. for 95 s. The PI was then etched using oxygen plasma (50 sccm $O_2$) at 60° C. for 16 min.

A Cr/Au (20/200 nm) bilayer was deposited as a seed layer for copper electroplating using argon plasma sputtering. A Cr/Cu bilayer or any other metal layer compatible with copper ECD can also be used as seed to reduce cost. The wafer was spun with photoresist AZ ECI 3027 at 1750 rpm for 30 s and was developed using AZ 726 MIF for 60 s to expose the area to be electroplated. The copper electroplating was done at 45° C. with 0.488 Amp current for 5 min to yield a 4 μm thick layer. The copper seed layer was then etched using argon plasma (30 sccm Ar, 150 W RF) for 3 min. Finally, the wafer was subjected to isotropic gas phase etching of amorphous silicon using $XeF_2$ for 60 cycles at 4 Torr to release the antenna.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%)

within the indicated range. The term "about" can include traditional rounding according to significant figures of numerical values. In addition, the phrase "about 'x' to 'y'" includes "about 'x' to about 'y'".

Therefore, at least the following is claimed:

1. A stretchable antenna, comprising:

a flexible support structure comprising a lateral spring section having a proximal end and at a distal end;

a metallic antenna disposed on at least a portion of the lateral spring section, the metallic antenna extending along the lateral spring section from the proximal end; and a metallic feed coupled to the metallic antenna at the proximal end of the lateral spring section, wherein the lateral spring section has a width w in a plane defined by the proximal end and the distal end, and wherein the lateral spring section elongates along a direction from the proximal end to the distal end, and the width w rotates out of the plane.

2. The stretchable antenna of claim 1, wherein the lateral spring section is a semicircular spring section.

3. The stretchable antenna of claim 1, wherein the lateral spring section is coupled at the proximal end to a first support pad and coupled at the distal end to a second support pad.

4. The stretchable antenna of claim 1, wherein the flexible support structure comprises a polymer.

5. The stretchable antenna of claim 4, wherein the polymer is polyimide.

6. The stretchable antenna of claim 1, wherein the metallic antenna comprises a metallic thin film disposed on the lateral spring section.

7. The stretchable antenna of claim 6, wherein the metallic thin film comprises copper (Cu), tungsten (W), aluminum (Al), or nickel (Ni).

8. The stretchable antenna of claim 1, wherein the lateral spring section includes at least two semi-circular parts.

9. The stretchable antenna of claim 1, further comprising:

a first support pad coupled to the proximal end to support the metallic feed; and a second support pad coupled to the distal end, wherein the first and second support pad extend in the plane.

10. The stretchable antenna of claim 1, wherein the lateral spring section includes plural semicircular portions, the plural semicircular portions extending in the plane when no stress is applied to the antenna, and the plural semicircular portions extending out of the plane when stress is applied to the antenna.

11. A method, comprising:

patterning a polymer layer disposed on a substrate to define a lateral spring section;

disposing a metal layer on at least a portion of the lateral spring section, the metal layer forming an antenna extending along the portion of the lateral spring section and having a proximal end and a distal end; and releasing the polymer layer and the metal layer from the substrate, wherein the lateral spring section has a width w in a given plane defined by the proximal end and the distal end, and wherein the lateral spring section elongates along a direction from the proximal end to the distal end, and the width w rotates out of the plane.

12. The method of claim 11, wherein the lateral spring section is a semicircular spring section.

13. The method of claim 11, wherein the lateral spring section extends between first and second support pads.

14. The method of claim 11, comprising disposing the polymer layer on the substrate.

15. The method of claim 14, wherein the polymer layer is disposed on the substrate by spin coating.

16. The method of claim 14, wherein the polymer layer comprises polyimide.

17. The method of claim 11, wherein the metal layer is disposed on the polymer layer by electroplating.

18. The method of claim 11, wherein the metal layer comprises a metallic thin film of copper (Cu), tungsten (W), aluminum (Al), or nickel (Ni).

19. The method of claim 11, further comprising:

forming a first support pad coupled to the proximal end; and forming a second support pad coupled to the distal end, wherein the first and second support pad extend in the plane.

20. The method of claim 11, wherein the lateral spring section includes plural semicircular portions, the plural semicircular portions extending in the plane when no stress is applied to the antenna, and the plural semicircular portions extending out of the plane when stress is applied to the antenna.

* * * * *